US006341206B1

(12) United States Patent
Yamaguchi et al.

(10) Patent No.: US 6,341,206 B1
(45) Date of Patent: Jan. 22, 2002

(54) IMAGE DEVELOPING APPARATUS HAVING DEVELOPER SEAL

(75) Inventors: Naoki Yamaguchi; Junichi Tanizaki; Takeshi Houman, all of Fukuoka; Toshimi Hattori, Saga; Yoshihiro Mizoguchi, Fukuoka; Yoshiaki Ijima, Fukuoka; Yuzo Kawano, Fukuoka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/590,650

(22) Filed: Jun. 8, 2000

(30) Foreign Application Priority Data

Jun. 10, 1999 (JP) ..... 11-163287
Jun. 10, 1999 (JP) ..... 11-163288
Aug. 5, 1999 (JP) ..... 11-222414

(51) Int. Cl.[7] ..... G03G 15/08
(52) U.S. Cl. ..... 399/103; 399/284
(58) Field of Search ..... 399/103, 105, 399/274, 284

(56) References Cited

U.S. PATENT DOCUMENTS 4,616,919 A * 10/1986 Adley et al. ..... 399/103
5,134,960 A * 8/1992 Shirai ..... 399/105
5,321,473 A * 6/1994 Azami ..... 399/103
5,587,551 A * 12/1996 Ikegawa et al. ..... 399/284
5,697,021 A 12/1997 Watanabe et al.
5,701,558 A * 12/1997 Kojima ..... 399/103
6,094,550 A * 7/2000 Kido et al. ..... 399/103

* cited by examiner

*Primary Examiner*—Robert Beatty
(74) *Attorney, Agent, or Firm*—Wenderoth, Lind & Ponack, L.L.P.

(57) ABSTRACT

An image developing apparatus has a photosensitive body, an image-developing roller, a toner feeding roller, a housing cassette, whereon the image-developing roller and the feeding roller are mounted, for storing the toner, a plate-like blade mounted on the housing cassette, a sheet member for preventing the toner from leaking, and toner sealing devices made of a resilient material for preventing the toner from leaking. The sheet member is displaced between a development area of the developing roller and a position of the pressed contact between the developing roller and the feeding roller. The sheet member maintains a uniformly contact along a longitudinal direction of the developing roller. The toner sealing devices are either mounted integrally to, or formed integrally with the blade as one unit, and provided at both ends of the blade. A space is provided between the toner sealing devices and the housing cassette. The structure of this invention realizes prevention of the toner from leaking in the image developing apparatus, since it effectively fills a space between the blade and the developing roller. Furthermore, the structure also improves productivity and reduces working processes, since it makes adhesion of the toner sealing devices unnecessary in manufacturing the image-developing apparatus.

20 Claims, 17 Drawing Sheets

IMAGE DEVELOPING APPARATUS HAVING DEVELOPER SEAL

FIELD OF THE INVENTION

The present invention relates to an image developing apparatus for developing an electrostatic latent image in an image forming apparatus employing an electrophotographic method such as a printer and the like.

BACKGROUND OF THE INVENTION

In an image forming apparatus employing an electrophotographic method, an image developing apparatus using a one-component developing agent (hereinafter referred to as ("toner") has so far been used. The image developing apparatus using one-component toner has such advantages as mentioned below when compared with one that uses two-component toner. First, it does not require a detecting device as well as a control device for a density of the toner. Secondly, it facilitates cleaning of a latent image carrying body without causing damage to a surface of it even if the latent image carrying body is cleaned with a plate-like resilient body after a visible image is transferred, since carrier does not stick to the latent image carrying body during the development. Thirdly, it can readily achieve a simplification and a reduction in size of the apparatus.

On the other hand of the above advantages, however, the image developing apparatus using one-component toner has a problem that toner not charged electrically leaks from ends of an image-developing roller, because it does not include a substance like the carrier in the two-component toner that is attracted to a magnet.

In the image developing apparatus using one-component toner, it is a common practice now to use an elastic foam material such as polyurethane foam or the like as means to seal in the toner. The elastic foam material provides an advantage of large elasticity, and thereby it can fill up easily spaces among the image-developing roller, a housing cassette, and a toner layer thickness regulating means (hereinafter referred to as "blade").

In the case of using elastic foam material as the sealing means, however, it is difficult to seal a space having an acute angle. In particular, it is unable to fill a space in a shape of wedge formed between a rounded portion of the image-developing roller and another rounded portion of the blade. Furthermore, a position of the sealing means cannot be aligned properly with respect to the blade, since the sealing means is attached to the housing cassette. In addition, the sealing means cannot be easily attached to a proper position, as it expands when being attached.

Hence, the image developing apparatus using one-component toner still has the problem of leakage of the toner for the above reasons. Moreover, it also has another problem of poor productivity, since it requires a sealing member such as a sponge to be attached to an inside of the housing cassette.

An image developing apparatus in which a detachable sealing member is attached to a side of a blade is disclosed in U.S. Pat. No. 5,697,021, as a measure to cope with the above problems. In the above disclosure, however, the sealing member is fixed in a manner to make a close contact with a housing cassette. On the other hand, since the sealing member is attached to the blade, the blade is affected by the sealing member. As a result, it presents a disadvantage that a thickness of the toner layer on an image-developing roller becomes uneven.

It is therefore an object of the present invention to provide an image developing apparatus that can prevent the toner from leaking, and assure a stable thickness of the toner layer in the image developing apparatus equipped with a blade.

SUMMARY OF THE INVENTION

An image developing apparatus of the present invention comprises a photosensitive body, an image-developing roller (hereinafter referred to as "developing roller"), a toner feeding roller, and a housing cassette, whereon the developing roller and the feeding roller are mounted, for storing the toner. The image developing apparatus also comprises a plate-like blade mounted on the housing cassette in a manner to keep a pressed contact with the developing roller, a sheet member for preventing a leakage of the toner, and a toner sealing means constructed of an resilient material for preventing the toner from leaking.

The sheet member is arranged between a development area of the developing roller and a position of the pressed contact between the image-developing roller and the feeding roller, and stays in uniform contact along a longitudinal direction of the developing roller.

The toner sealing means is either mounted integrally to, or formed integrally with the blade as one unit, and is provided at each end of the blade. Further, a space is provided between the toner sealing means and the housing cassette.

The above structure of the present invention realizes prevention of the toner from leaking in the image developing apparatus, since it effectively fills a space located between the blade and the developing roller.

Furthermore, the structure also realizes an improvement of productivity and a reduction of working processes, since it makes an adhesion of the toner sealing means unnecessary in manufacturing the image-developing apparatus.

DESCRIPTION OF THE PREFERRED EMBODIMENTS

FIRST EXEMPLARY EMBODIMENT

Figure 1:
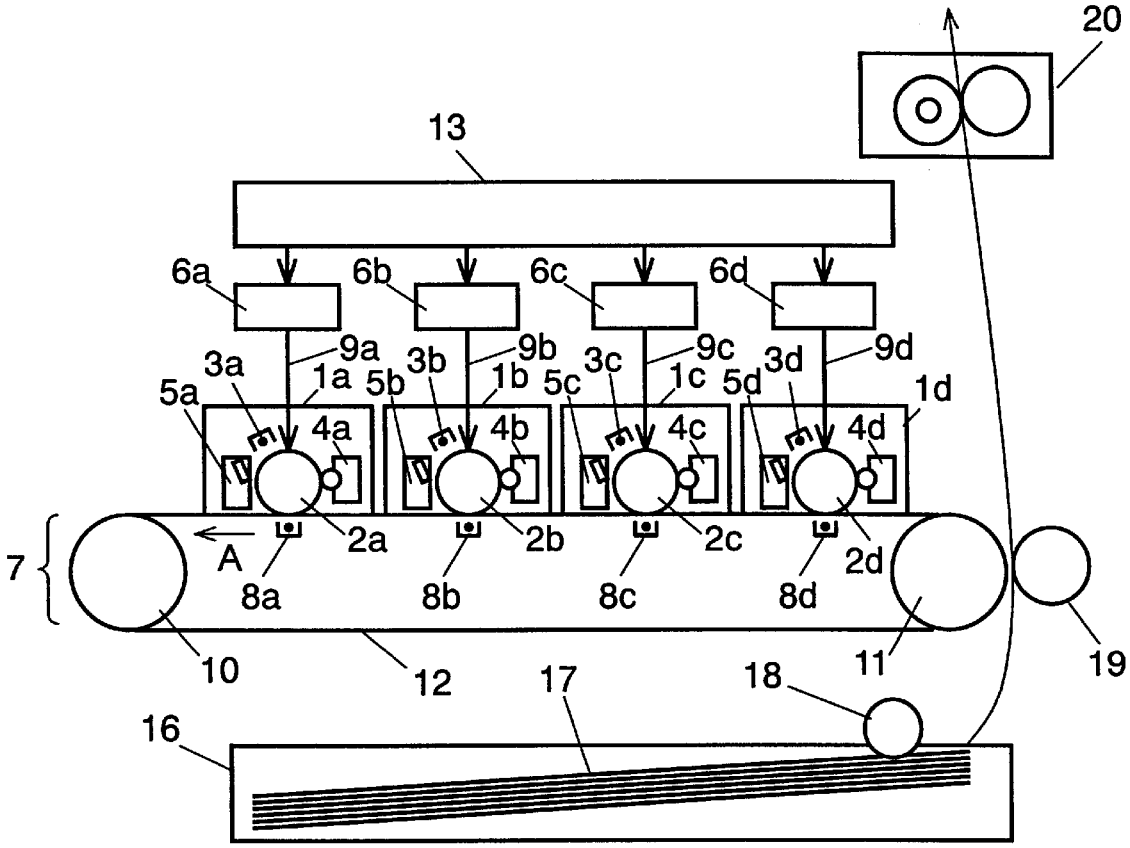
FIG. 1 is a schematic view of an image forming apparatus provided with an image developing apparatus of the present invention.

A first exemplary embodiment of the present invention will be described hereinafter with reference to FIG. 1 through FIG. 9. In the drawings, the same reference numerals have been used throughout to indicate identical components, and their repeated descriptions are omitted.

Figure 2:
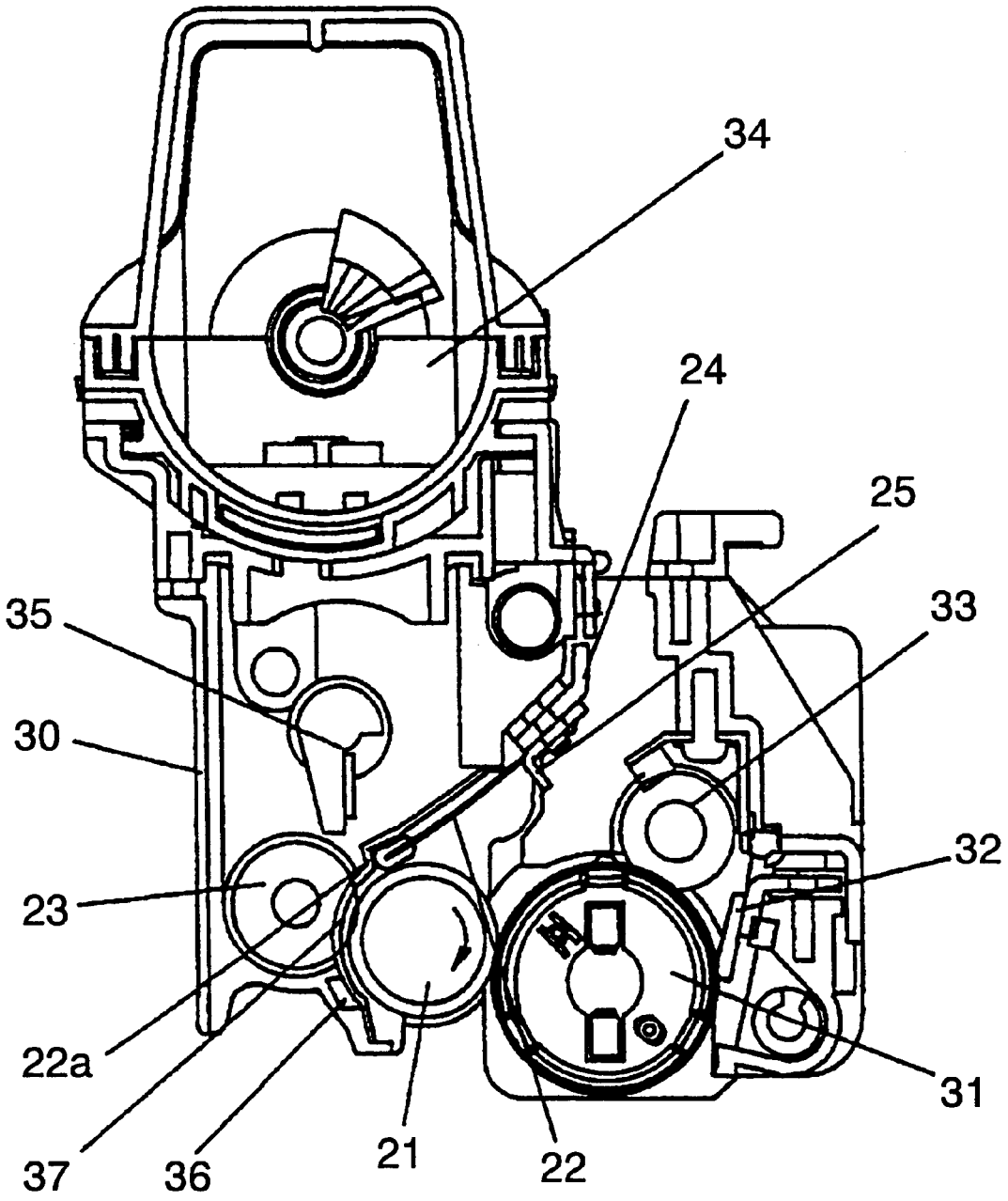
FIG. 2 is a sectional view of a processing unit including the image developing apparatus of this invention.
Figure 3:
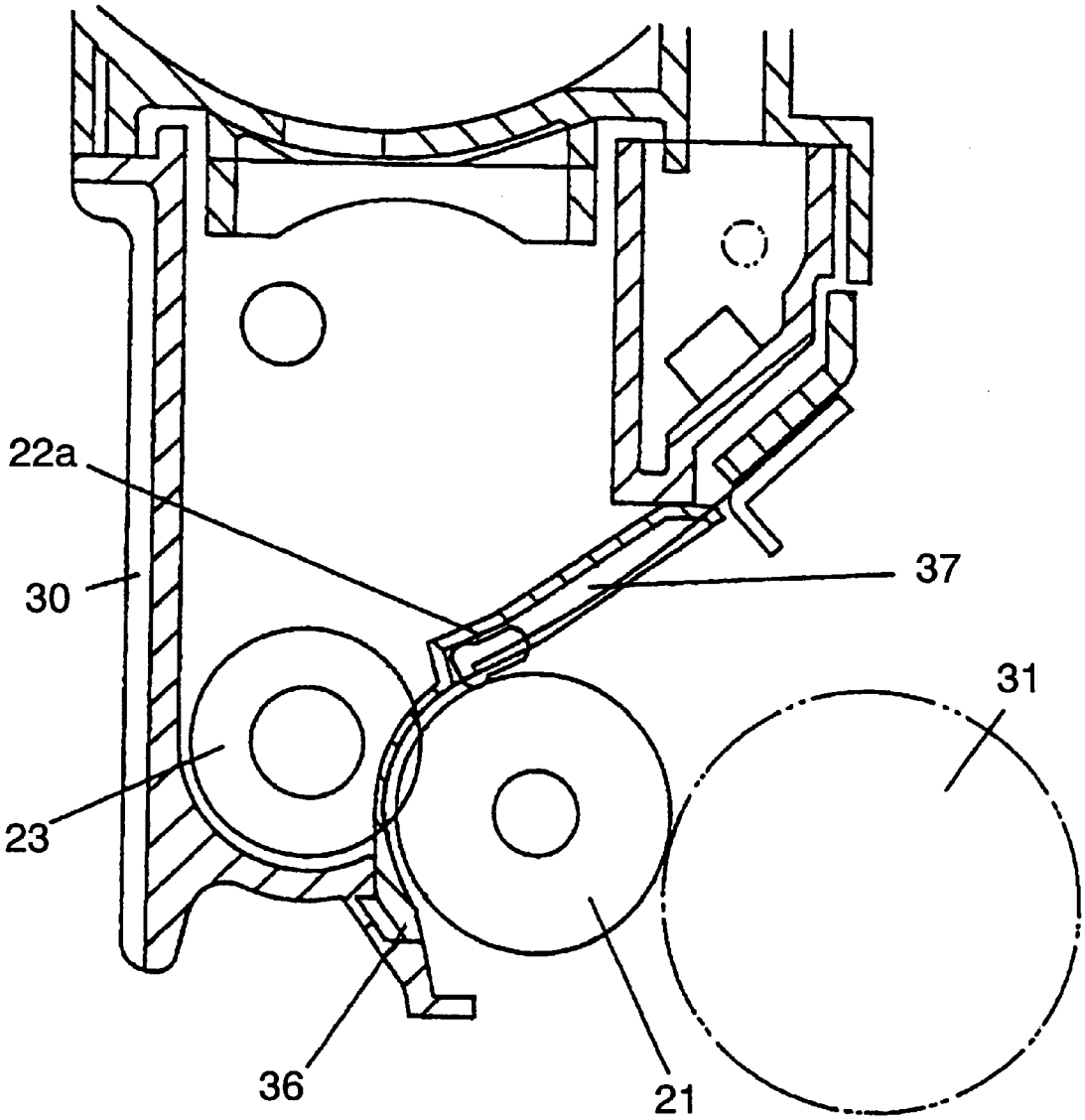
FIG. 3 is an enlarged sectional view of an essential portion of FIG. 2.
Figure 4:
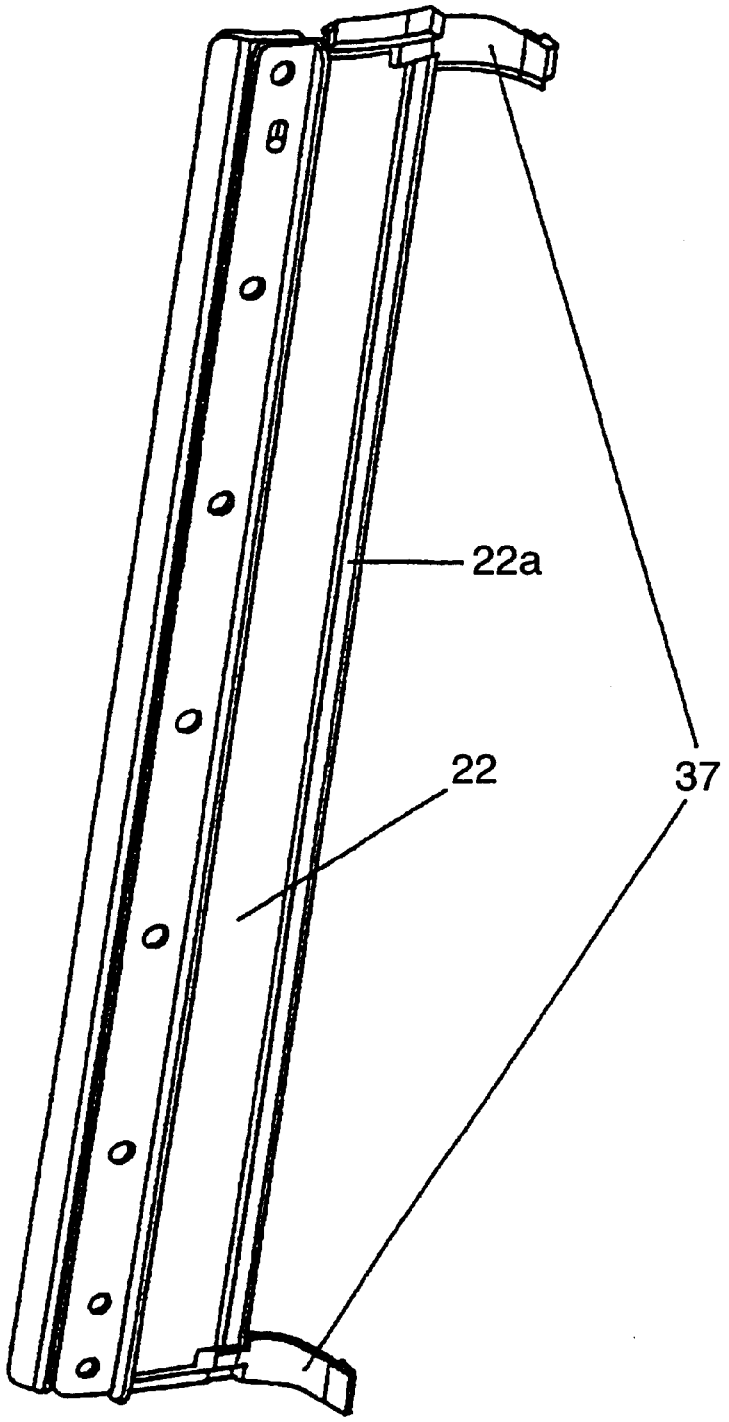
FIG. 4 is a perspective view of an exemplary embodiment of toner sealing means and a blade of this invention.
Figure 5:
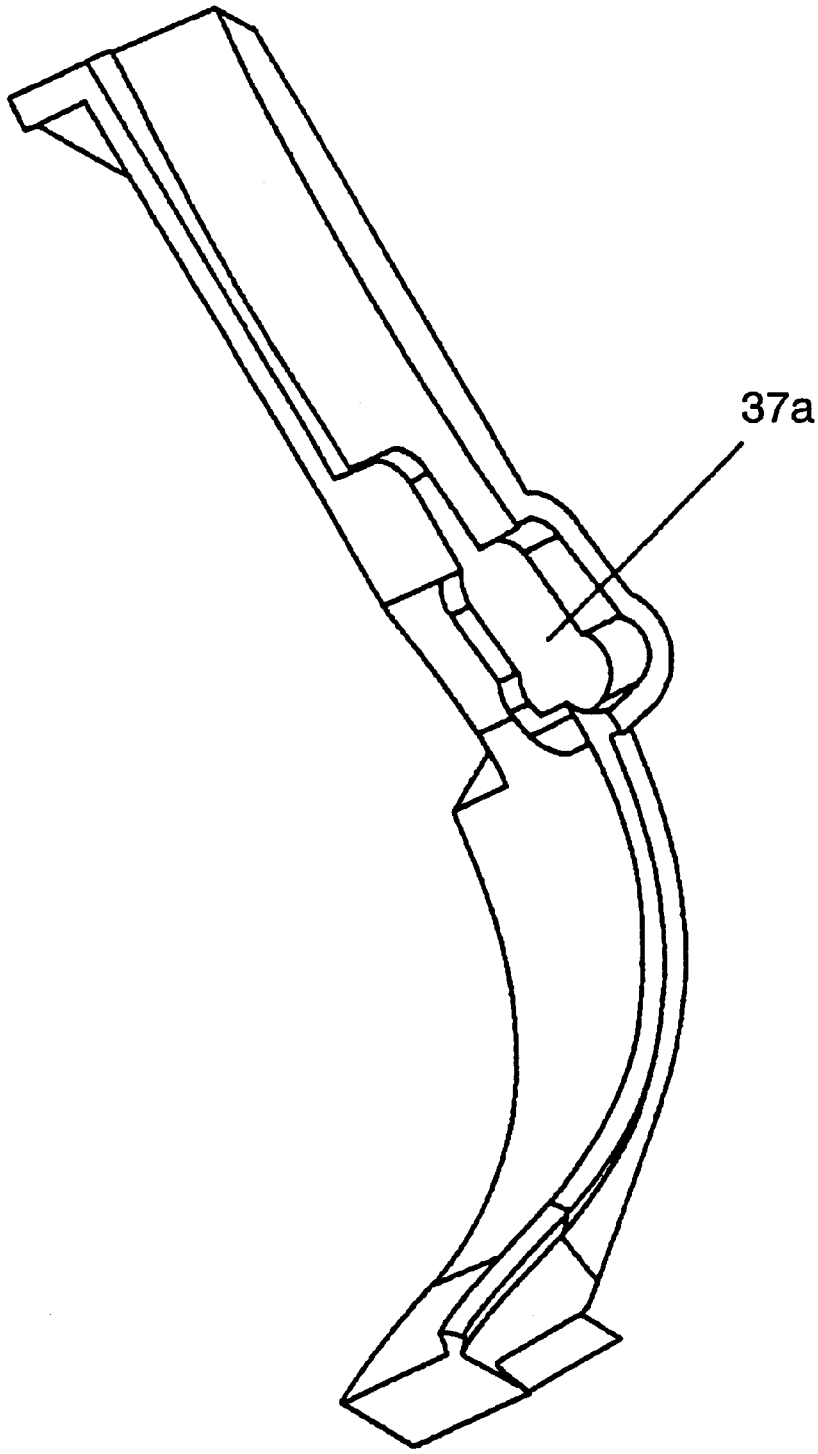
FIG. 5 is a perspective view of another exemplary embodiment of toner sealing means of this invention.
Figure 6:
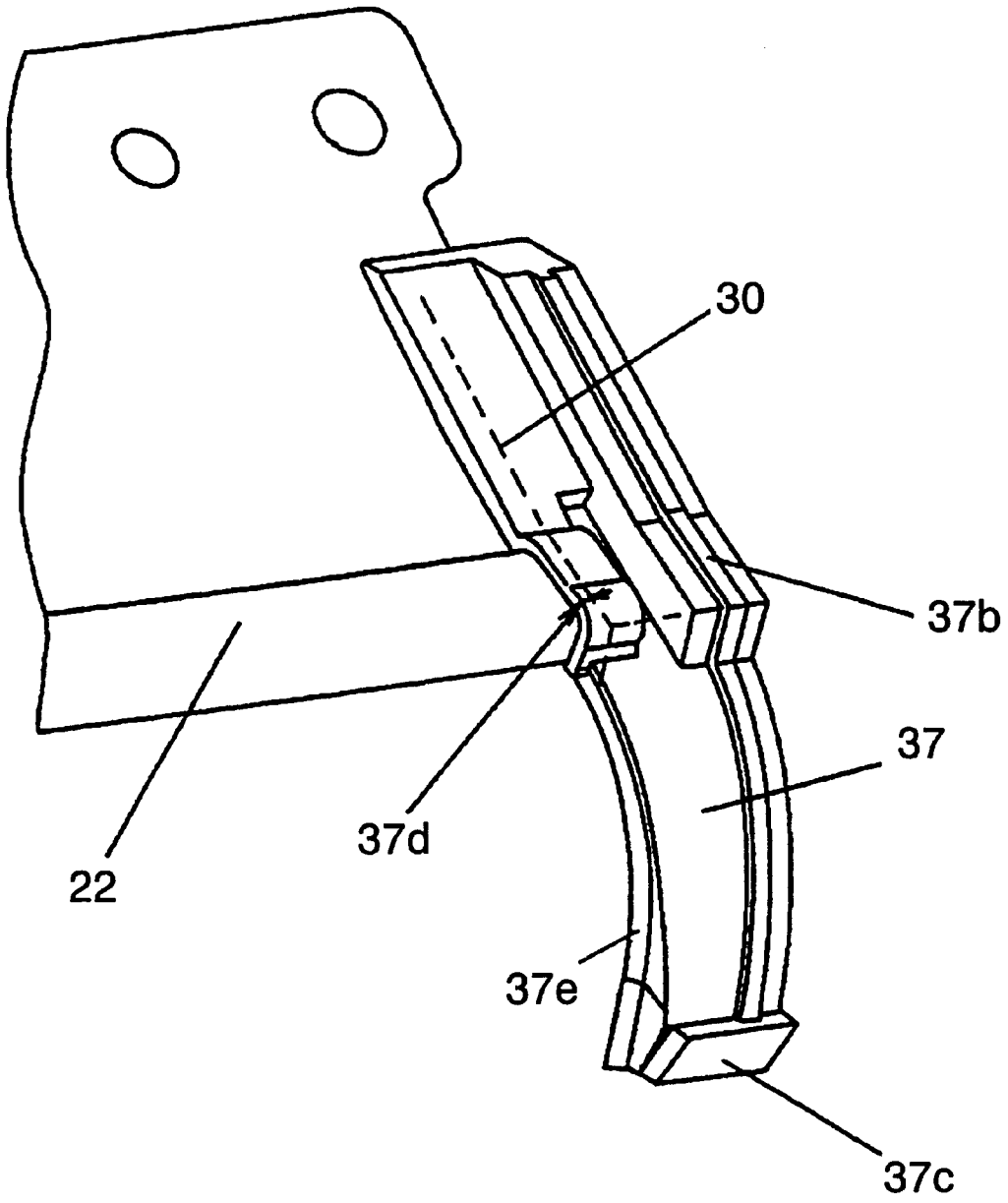
FIG. 6 is a perspective view of an exemplary embodiment of toner sealing means and a blade of this invention.
Figure 7:
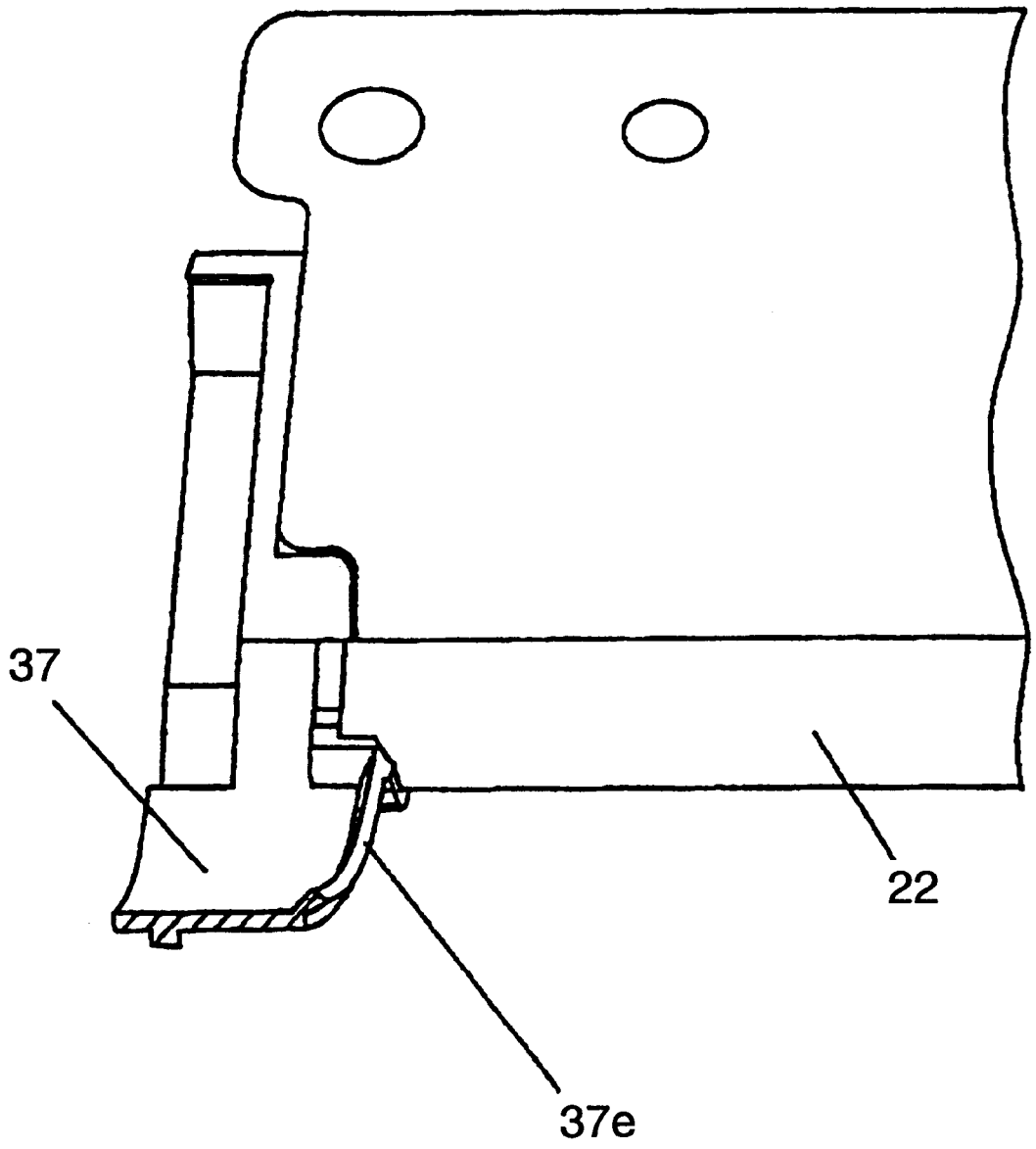
FIG. 7 is a perspective view of still another exemplary embodiment of toner sealing means and a blade of this invention.
Figure 8:
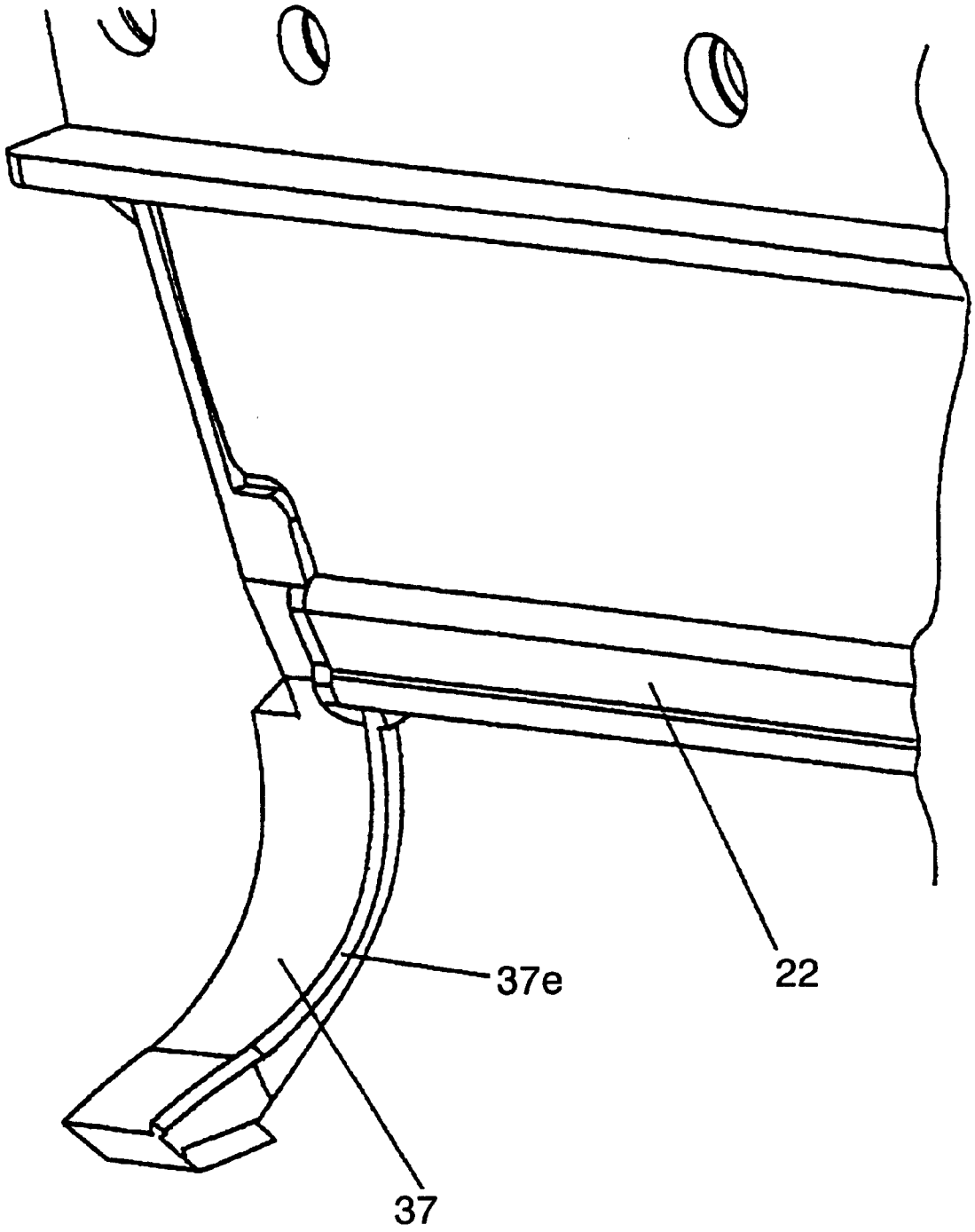
FIG. 8 is an enlarged perspective view of an essential portion of FIG. 7.
Figure 9:
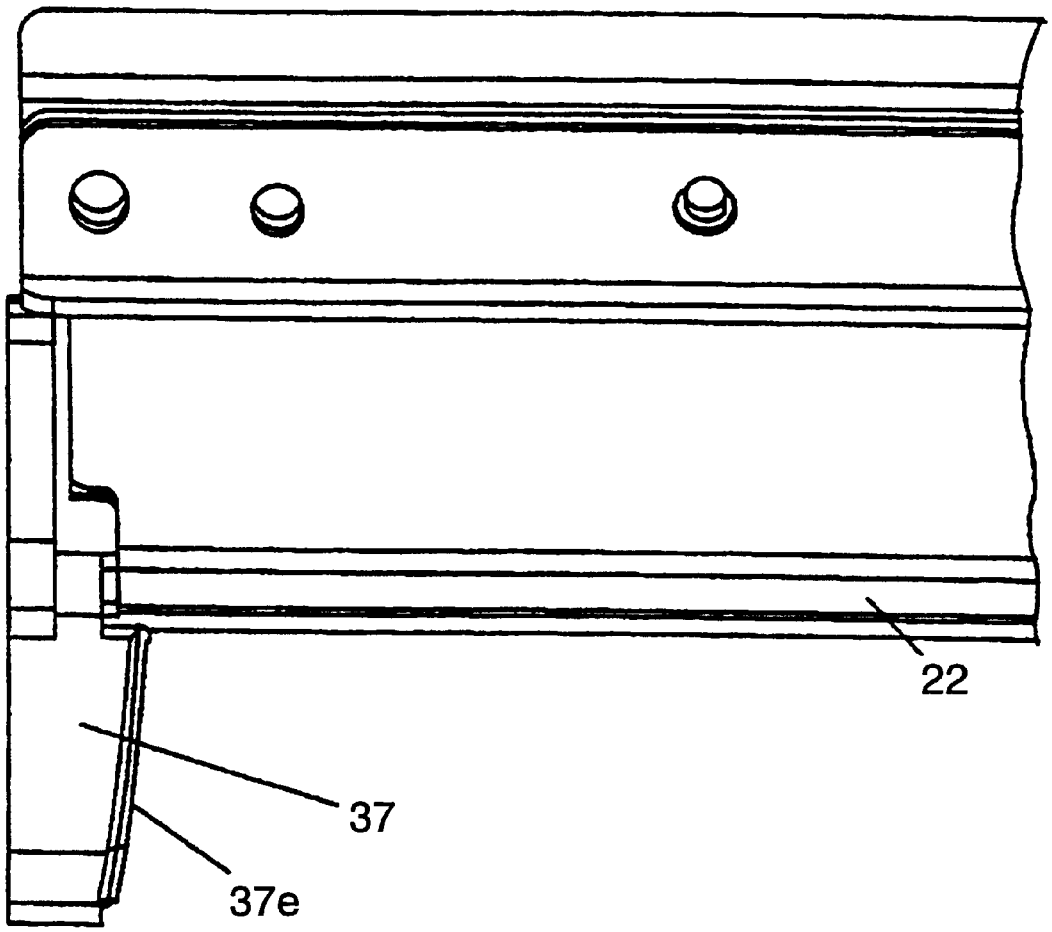
FIG. 9 is a plan view of FIG. 7.

FIG. 1 is a schematic view of an image forming apparatus in which an image developing apparatus of the present invention is installed. FIG. 2 is a sectional view of a processing unit including the image developing apparatus installed in the image forming apparatus of FIG. 1. FIG. 3 is an enlarged sectional view of an essential portion of FIG. 2. FIG. 4 is a perspective view of an example of toner sealing means and a blade of this exemplary embodiment. FIG. 5 is a perspective view of another example of toner sealing means of this exemplary embodiment. FIG. 6 is a perspective view of an example of toner sealing means and a blade of this exemplary embodiment. FIG. 7 is a perspective view of still another example of toner sealing means and a blade of this exemplary embodiment. FIG. 8 is an enlarged perspective view of an essential portion of FIG. 7. FIG. 9 is a plan view of FIG. 7.

In the image forming apparatus of this exemplary embodiment, there are arranged four image forming stations ("processing units") 1*a*, 1*b*, 1*c*, and 1*d*, as shown in FIG. 1. Each of the processing unit 1*a*, 1*b*, 1*c* and 1*d* comprises:

a photosensitive drum ("photosensitive body"), 2*a*, 2*b*, 2*c* or 2*d*, serving as an image carrying body;

a charging means (device), 3*a*, 3*b*, 3*c* or 3*d*, for uniformly charging a surface of the respective photosensitive drum, 2*a*, 2*b*, 2*c* or 2*d;* an image developing means (device) ("developing means (device)"), 4*a*, 4*b*, 4*c* or 4*d*, for making an electrostatic latent image into a visible image;

a cleaning means (device), 5*a*, 5*b*, 5*c* or 5*d*, for removing residual toner;

an exposure means (device), 6*a*, 6*b*, 6*c* or 6*d*, having an optical scanning system for irradiating light corresponding to an image information to an individual photosensitive drum, 2*a*, 2*b*, 2*c* or 2*d*; and a toner transfer means (device), 8*a*, 8*b*, 8*c* or 8*d*, for transferring a toner image to an intermediate transfer belt ("transferring member") 12 constituting an image transfer means (device) 7.

In the processing units 1*a*, 1*b*, 1*c*, and 1*d*, there are formed a yellow image, a magenta image, a cyan image and a black image respectively. The exposure means 6*a*, 6*b*, 6*c*, and 6*d* output exposing lights 9*a*, 9*b*, 9*c*, and 9*d*, corresponding respectively to the yellow image, the magenta image, the cyan image, and the black image.

The endless intermediate transfer belt 12 supported by rollers 10 and 11 is arranged underneath the photosensitive drums 2*a*, 2*b*, 2*c*, and 2*d*, and it circularly moves in a direction of an arrow A.

Further, sheet material 17 stored in a paper feeder cassette 16 is fed by a paper feeding roller 18, and carried to a paper output tray (not shown) through an image transfer roller 19 and a fixing means (device) 20.

In a color image forming apparatus of the above-described structure, a latent image of a black color is produced first on the photosensitive drum 2*d* by the well-known electro-photographic process at the image forming station 1*d*. The latent image is then made visible as a black toner image by the developing means 4*d* with black toner, and the black toner image is transferred to the intermediate transfer belt 12 by the toner transfer means 8*d*.

On the other hand, a latent image of a cyan color is produced at the image forming station 1*c*, while the black toner image is transferred to the intermediate transfer belt 12. This latent image is made visible as a cyan toner image by the developing means 4*c* with cyan toner, and it is transferred by the toner transfer means 8*c* in a manner to superpose upon the black toner image previously transferred on the intermediate transfer belt 12.

Subsequently, image formations are made in the same manner for a magenta toner image and a yellow toner image, and superposition of the toner images in four different colors on the intermediate transfer belt 12 is completed. Afterwards, the four-colored toner image is transferred at once by the image transfer roller 19 onto a sheet material 17 such as a sheet of paper taken out of the paper feeder cassette 16 by the paper feeding roller 18. The image is then thermally fixed by the fixing means 20, and a full color image is thus obtained on the sheet material 17.

A printing operation is completed when residual toner is removed from each of the photosensitive drums 2*a*, 2*b*, 2*c* and 2*d* upon end of the image transfer by their respective cleaning means 5*a*, 5*b*, 5*c* and 5*d* in preparation for the subsequent image formation to be continued.

As shown in FIG. 2 and FIG. 3, there are a photosensitive drum 31, a charging means (device) 33, an developing roller 21, a blade 22, and a toner feeding roller ("feeding roller") 23, all mounted on a housing cassette 30 of the processing unit.

The blade 22 is disposed in pressed contact with the developing roller 21, parallel to its rotational axis, to form a thin layer of the toner that is attached to the developing roller 21. The feeding roller 23 supplies the toner taken out of a toner cartridge 34 and stirred by an agitator 35 to the developing roller 21. The developing roller 21 and the toner feeding roller 23 rotate in a same direction with respect to each other, and the photosensitive drum 31 rotates in a direction opposite to them.

A cleaning means (device) 32 is mounted on the housing cassette 30 to clean an outer peripheral surface of the photosensitive drum 31.

A distance between the rotational axis of the developing roller 21 and a rotational axis of the toner feeding roller 23 is designed to be smaller than a sum of radii of the image-developing roller 21 and the toner feeding roller 23, and thereby the two rollers make pressed contact. A magnitude of the pressed contact in this embodiment is approximately 0.3 to 1.5 mm.

The developing roller 21 is made by integrally molding an elastic material such as silicon rubber, polyurethane rubber, or the like, which are given an electrical conductivity with an addition of carbon in a thickness of approx. 0.5 to 4 mm over a periphery of a metal shaft. The conductive elastic material is designed to have a volume resistivity of approx. $10^2$ ohm-cm to $10^7$ ohm-cm. In addition, the toner feeding roller 23 is made with polyurethane foam or like material molded integrally on a periphery of a metal shaft.

An amount of nonmagnetic one-component toner is stored in the toner cartridge 34, and the toner falls in the housing cassette 30. The toner is stirred by the agitator 35 to prevent the toner from clogging, while the toner is also transferred at the same time toward the toner feeding roller 23 by the agitator 35.

The toner feeding roller 23 causes the toner to be attached on the developing roller 21 at its contacting portion with the developing roller 21. At the same time, the toner feeding roller 23 rotates at a different speed relative to the developing roller 21 in a manner to scrape residual toner off the developing roller 21 after completion of the image development. The removed toner is mixed with unused toner in the housing cassette 30, and reused again.

The blade 22 is a constituent member having an elastic rubber material to regulate a thickness of the toner layer, and one end of it is fixed to resilient supporting members 24 and 25.

The blade 22 consists of metal such as a phosphor bronze plate, a stainless steel spring, or like material, and a rubber member 22*a* attached to a free end is formed into a shape of circular arc in cross-section, with which it is in pressed contact to the developing roller 21. A radius of the circular arc portion is made to be 0.5 to 1.5 mm to obtain a necessary thickness of the toner layer and to obtain sufficient electrical charges on the toner.

A material for the rubber member 22*a* is selected among those that have a large disparity in order of frictional electrification level from the toner, as the toner needs to be charged. Polymer materials such as silicone rubber, Teflon rubber, polyimide, polyester rubber, polyurethane rubber, and the like, for instance, are used as a main component.

The toner supplied by the feeding roller 23 to the developing roller 21 is regulated of its layer thickness with the blade 22, and charged in a same polarity as a charging polarity of the photosensitive drum 31. The charged toner comes in contact with the rotating photosensitive drum 31, and an image is developed when the toner is attracted to an electric charge of the electrostatic latent image formed on the photosensitive drum 31, while a bias potential is applied to the developing roller 21 by a bias voltage supply source (not shown). Residual toner after a completion of the image development is collected again in the housing cassette 30 and mixed with new toner, as previously described.

It is necessary to adjust a line pressure of contact to 10 gf/mm or less between the blade 22 and the developing roller 21. This is because a rotational load torque for the developing roller 21 becomes excessive if it exceeds 3.5 kgf-cm.

A sheet member 36 is disposed around the developing roller 21 to prevent the toner from leaking. The sheet member 36 is formed, for instance, with polyurethane rubber, PET film, or like material. The sheet member 36 is disposed in a position downstream side of a development area of the developing roller 21 in its rotating direction, and, also, in a position upstream side of the pressed contact position with the feeding roller 23 in the rotating direction. The sheet member 36 stays uniformly in contact with the image-developing roller 21 in its longitudinal direction.

The blade 22 is provided with toner sealing means (device) 37 for preventing the toner from leaking at both ends of a portion where it makes pressed contact with the developing roller 2.

A frictional resistance between the toner sealing means 37 and the developing roller 21 tends to become large, because the toner sealing means 37 is in contact with a rubber portion of the developing roller 21. For this reason, the toner sealing means 37 are formed with an elastic material having good slide characteristics and abrasion resistance such as nitrite rubber, acrylic rubber, silicone rubber, fluorocarbon-rubber, tetrafluorocarbon-resin, or like material. Rubber materials, polymeric materials or like materials can be used as the elastic material of the sealing means 37. The toner sealing means 37 are mounted integrally at both ends in a longitudinal direction of the blade 22, as shown in FIG. 4, and they are fixed with bonding means such as adhesive, double-sided adhesive tape, and the like. In addition, the toner sealing means 37 and the blade 22 may be molded integrally with same material or with different materials. Thus, the blade 22 is made into one unit with the toner sealing means 37.

The above structure can ensure positioning of the toner sealing means 37 as compared with a sponge material or the like attached to a housing cassette with double-sided tape, etc. as has been practiced previously. Accordingly, it can fill the space between the blade 22 and the developing roller 21 due to a variation in adhering position, a deviation in the dimensions of the housing cassette, and so on, thereby making it possible to prevent the toner from leaking.

Furthermore, the above structure makes it unnecessary to attach the toner sealing means 37 to a place within the housing cassette 30 where is not easy to work with, and therefore it can improve productivity and reduce working processes.

In this embodiment, the structure may be altered in a such way that the toner sealing means 37 and the blade 22 are engaged and they are fixed together with adhesive, a double-sided tape, etc., by making a portion of the toner sealing means 37 into a shape 37*a* that fits with an end of the blade 22, as shown in FIGS. 5 and 6.

With this structure, a space in a shape of wedge developed between the developing roller 21 and the blade 22, which was not able to be filled with a conventional sponge material, can be filled to positively prevent the toner from leaking. Moreover, it also realizes an improvement in accuracy of installation, since the two components are engaged with each other.

Incidentally, a problem may arise that a regulated layer thickness is not obtained, or the layer is not formed uniformly in thickness, and so on, if an external force is placed on the blade 22 for making the toner into a thin layer on the developing roller 21.

Thus, a space 37*d* of a predetermined dimension (0.5 mm or more, for instance) is formed in the toner sealing means 37 of this exemplary embodiment, as shown in FIG. 6, so that no portion of the toner sealing means touches the housing cassette 30 within a range of the toner layer thickness regulated by the blade 22. This avoids the blade 22 from being adversely influenced by the housing cassette 30 via the toner sealing means 37, thereby realizing a stable formation of the toner layer of uniform thickness. This is one of advantageous features of the present invention.

In this instance, the toner sealing means 37 have been fixed with a double-sided tape or the like, when they are built into the housing cassette 30 in the past, as described above.

Hence, it has given rise to a problem that there is not a chance to replace the toner sealing means 37 even when an error or a failure occurs in placing them, if they are fixed to the housing cassette 30 with double-sided tape.

Accordingly, each of the toner sealing means 37 in this exemplary embodiment is provided with a projection 37*b* of approx. 0.5 to 3.0 mm in width and approx. 0.3 to 1.0 mm in height, for instance, formed over an entire length in a peripheral direction of a portion where the toner sealing means comes in contact with the housing cassette 30, as shown in FIG. 6. In addition, a groove (not show in the figure) is formed in the housing cassette 30 in a portion facing the projection 37*b*, so that they engage with each other by press fitting. The projection and the groove may be reversed in their positions. This makes it unnecessary to fix the toner sealing means 37 with a double-sided tape or adhesive when assembling them, thereby making remounting and reassembling easy. Furthermore, this portion can also prevent the toner from leaking, since they are press-fitted together.

In addition, each of the toner sealing means 37 is provided with a turn-restricting projection 37*c*, also serving as a positioning means, formed on a side toward the housing cassette 30 at an opposite end from the position where the blade 22 is mounted, in order to prevent the toner sealing means 37 from being taken away by a rotational movement of the developing roller 21, as shown in FIG. 6. Also, the housing cassette 30 is provided with turn-restricting recesses (not show in the figure) formed in portions facing the respective projections 37*c*, and they are engaged by press fitting.

Nitrile rubber, acrylic rubber, silicone rubber, fluorocarbon-rubber, tetrafluorocarbon-resin, and the like are used for the toner sealing means 37. With regard to a coefficient of friction, it is desirable for the toner sealing means 37 to have a coefficient of dynamic friction in a range of 0.1 to 0.8 for the portion that comes in contact with the developing roller 21. If the coefficient of friction is too low, it tends to easily allow the toner to get into the image developing apparatus and to cause toner leakage. If the coefficient of friction is too high, on the other hand, such problems as an increase in load torque of the image developing apparatus, and heat rise due to friction occur. When any material other than fluorocarbon-resin is used for the toner sealing means 37, it is desirable to provide a coating of fluorocarbon-resin on the portion of the toner sealing means 37 where it comes in contact with the developing roller 21, in order to reduce the coefficient of friction.

Next, each of the toner sealing means 37 may be so constructed that a ridge-shaped rib 37*e* having a tilt with respect to an axis of the developing roller 21 is formed on an inner peripheral side of the toner sealing means 37, in such a manner that an edge of the rib stays in contact with the developing roller 21, as shown in FIG. 7 to FIG. 9. This structure can minimize a surface area of the contact between the toner sealing means 37 and the developing roller 21, thereby making it possible to prevent an increase of the load torque and a consequent temperature rise due to friction.

It is desirable for the ridge-shaped ribs 37*e* to be approx. 0.5 to 2.0 mm in height, 0.5 to 1.5 mm in width, and 30 to 60 degrees in tilting angle. It is also desirable for the ridge-shaped ribs 37*e* to bite into the developing roller 21 at a depth of 0.1 to 0.8 mm. Further, the ridge-shaped rib 37*e* is formed on the inner side of each of the toner sealing means 37 in a leaning manner such that the toner is pushed back into the housing cassette 30 as the developing roller 21 rotates.

A reason for the ridge-shaped ribs 37*e* formed with the tilt as described above is that if toner collects behind the ridge-shaped ribs 37*e*, the toner melts and clings to the ribs because it is heated by frictional heat at all times. Accordingly, the ridge-shaped ribs 37*e* formed with the tilt, like this exemplary embodiment, for pushing the toner back into the housing cassette 30 can prevent the toner from collecting around the ribs and solve the clinging problem of the toner.

Next, a relation of relative height between the blade 22 and the ridge-shaped ribs 37*e* will be described.

A leakage of toner can occur through gaps formed between the ridge-shaped ribs 37*e* of the toner sealing means 37 and the developing roller 21, if the blade 22 is higher than the toner sealing means 37 with respect to the developing roller 21. In addition, a leakage of the toner can also occur through a gap formed between the blade 22 and the developing roller 21, if the ridge-shaped ribs 37*e* are higher than the blade 22.

Therefore, the structure of this exemplary embodiment is such that the blade 22 and the ridge-shaped ribs 37*e* are in a concyclic position with respect to the developing roller 21, when all the components are assembled. This can thus prevent the toner from leaking.

In addition, the toner occasionally migrates into both ends of the blade 22 through small gaps between the toner sealing means 37 and the blade 22 when they are bonded.

Furthermore, there occasionally is a case in which the toner comes off the developing roller 21 and scatters over the housing cassette 30 if the toner gets beyond the range of the blade 22, since the toner carries no electrical charge.

For this reason, each of the ridge-shaped ribs 37*e* of the toner sealing means 37 is so constructed that its upstream side with respect to a rotational direction of the developing roller 21 is located at an outside of the range of the blade 22, and a downstream side is located inside of the range regulated by the blade 22. This enables the ribs 37*e* to guide the toner migrating through the gap toward the ends of the blade 22 and the toner out of the range of the blade 22 back into the housing cassette.

Polyurethane rubber, PET film, and the like are used for material of the sheet member 36, and a thickness of 0.05 to 1.0 mm is desirable. The sheet member 36 is attached to the housing cassette 30 with a double-sided tape, etc., and its distal end is made to contact with a surface along a longitudinal direction of the developing roller 21. The ridge-shaped ribs 37*e* also bite into the sheet member 36 by approx. 0.1 to 1.0 mm. The sheet member 36 and the ridge-shaped ribs 37*e* on the toner sealing means 37 are so constructed as to have areas where they intersect with each other along a circumferential direction of the developing roller 21.

Accordingly, this structure prevents the toner sealing means 37 from being taken away by the developing roller 21, and avoids a seal of the toner from becoming ineffective. In addition, it provides a complete filling of the space between the sheet member 36 and the toner sealing means 37 without employing other structural members.

As has been described, the present invention can provide the following merits.

The invention realizes a prevention of leakage of the toner, since it can fill the space formed between the blade and the developing roller. The invention also realizes an improvement of productivity and a reduction of working processes in manufacturing the image developing apparatus, since it makes adhesion of the toner sealing means unnecessary.

The structure, in which both ends of the blade and the toner sealing means are fixed by engaging them together, can achieve an advantageous effect to positively fill the spaces between the blade and the toner sealing means.

The structure, in which the space is formed between the toner sealing means and the housing cassette, can realize a stable formation of toner layer with a uniform thickness, since the blade never receives any influence by the housing cassette via the toner sealing means. The structure, in which the toner sealing means and the housing cassette are fixed by fitting them with the projections and the grooves, makes it easy to assemble and reassemble them together. Furthermore, the fitting portions between the toner sealing means and the housing cassette can prevent the toner from leaking.

The structure, in which a coefficient of friction is adjusted to the predetermined value at the portion of the toner sealing means comes in contact with the developing roller, can eliminate such troubles as migration of the toner between the toner sealing means and the developing roller, and an increase of the load torque of the apparatus. The structure having the ridge-shaped rib formed on the toner sealing means enables the edge of the ridge-shaped rib to make a contact with the developing roller. The structure can therefore provide a small contact area between the toner sealing means and the developing roller. This, therefore, makes it possible to prevent an increase of the load torque and a consequent temperature rise due to a friction.

The structure, in which the ridge-shaped rib is formed with the tilt on the inner side of the toner sealing means, can prevent the toner from staying around the toner sealing means, and avoid it from clinging due to frictional heat.

The structure, in which the blade and the ridge-shaped rib are formed to be in a concyclic position with respect to the developing roller, can prevent the toner from leaking, because they can eliminate gaps between the toner sealing means and the developing roller or between the blade and the developing roller.

The structure, in which he ridge-shaped ribs are so formed that their upstream side with respect to a rotational direction of the developing roller lies outside of the range of the blade and their downstream side lies inside of the range regulated by the blade, can guide the toner migrating through the ends of the blade back into the housing cassette.

The structure providing the sheet member and the ridge-shaped ribs to have areas of intersection can prevent the ineffective sealing resulting from the toner sealing means being taken away by friction with the developing roller. Thus, the structure can provide a complete filling of the space between the sheet member and the toner sealing means.

SECOND EXEMPLARY EMBODIMENT

A second exemplary embodiment of the present invention will be described hereinafter with reference to the accompanying drawings.

An image developing apparatus of this exemplary embodiment has a structure wherein the blade and the toner sealing means described in the first exemplary embodiment are integrally formed with resilient materials.

Figure 10:
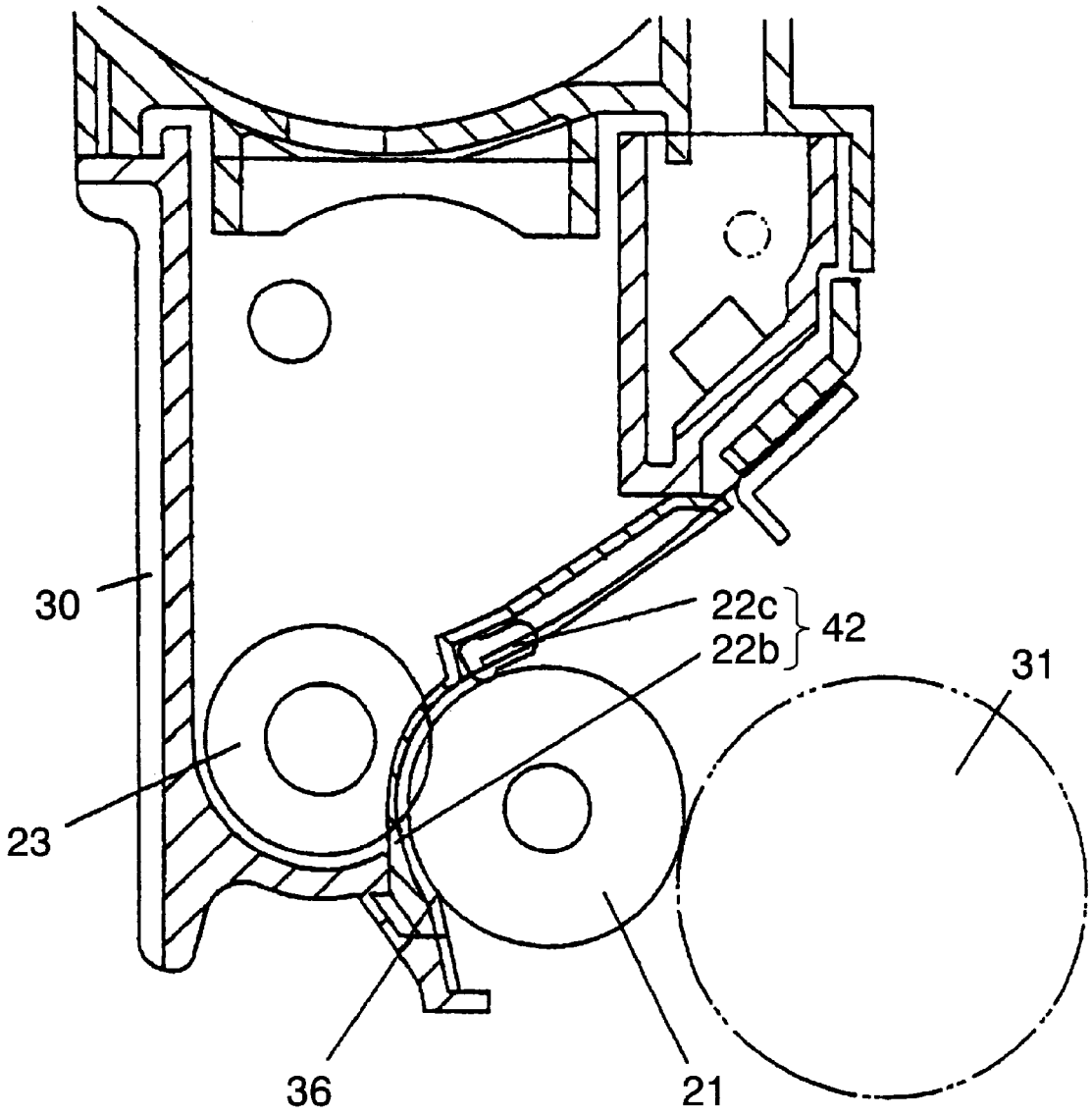
FIG. 10 is an enlarged sectional view of an essential portion of FIG. 2.

The image developing apparatus of this exemplary embodiment is provided with a blade having a function of a toner sealing unit 42 ("toner layer thickness regulating means having a function of a sealing means") to make toner attached to an developing roller 21 into a thin layer, and to prevent the toner from leading around edges of the developing roller 21, as shown in FIG. 10.

A unit 42 comprises a blade portion (toner layer thickness regulating portion) 22*c* provided in a pressed contact with the developing roller 21, parallel to its rotational axis, for forming a thin layer of the toner attached to the developing roller 21, and toner seating portions 22*b* formed integrally with the blade portion 22*c* at both of its ends, for preventing the toner from leaking by making a pressed contact with a peripheral surface of the developing roller 21. The blade portion 22*c* is formed so that it has a circular arc in cross section where it makes the pressed contact with the peripheral surface of the developing roller 21.

The unit 42 has a substrate made of a sheet metal such as a phosphor bronze plate, a stainless steel spring, or the like, and the blade portion 22*c* and the toner seal portions 22*b* are integrally formed with a resilient material such as rubber.

This structure can ensure a reliable positioning of the unit 42 in order to fill a space between blade portion 22*c* and the developing roller 21, as compared with the conventional one in which a sponge material or the like is attached to the housing cassette with double-sided tape or the like. Accordingly, this structure can fill the space formed between the blade portion 22*c* and the developing roller 21 due to a variation in adhering position, a deviation in the dimensions of the housing cassette, and so on, or a space in a shape of a wedge formed between the developing roller 21 and the blade portion,22*c*, which is in no way able to be filled with a sponge material, and thereby it making it possible to prevent the toner from leaking.

In addition, the above structure makes unnecessary a process of attaching the toner sealing portions 22*b* to a place within the housing cassette 30 where it is not easy to work with. Therefore, it can improve productivity and reduce the working processes. Furthermore, it can reduce a number of, and therefore a cost of components, since the blade portion 22*c* and the toner sealing portions 22*b* are formed integrally with the same resilient material.

Figure 11:
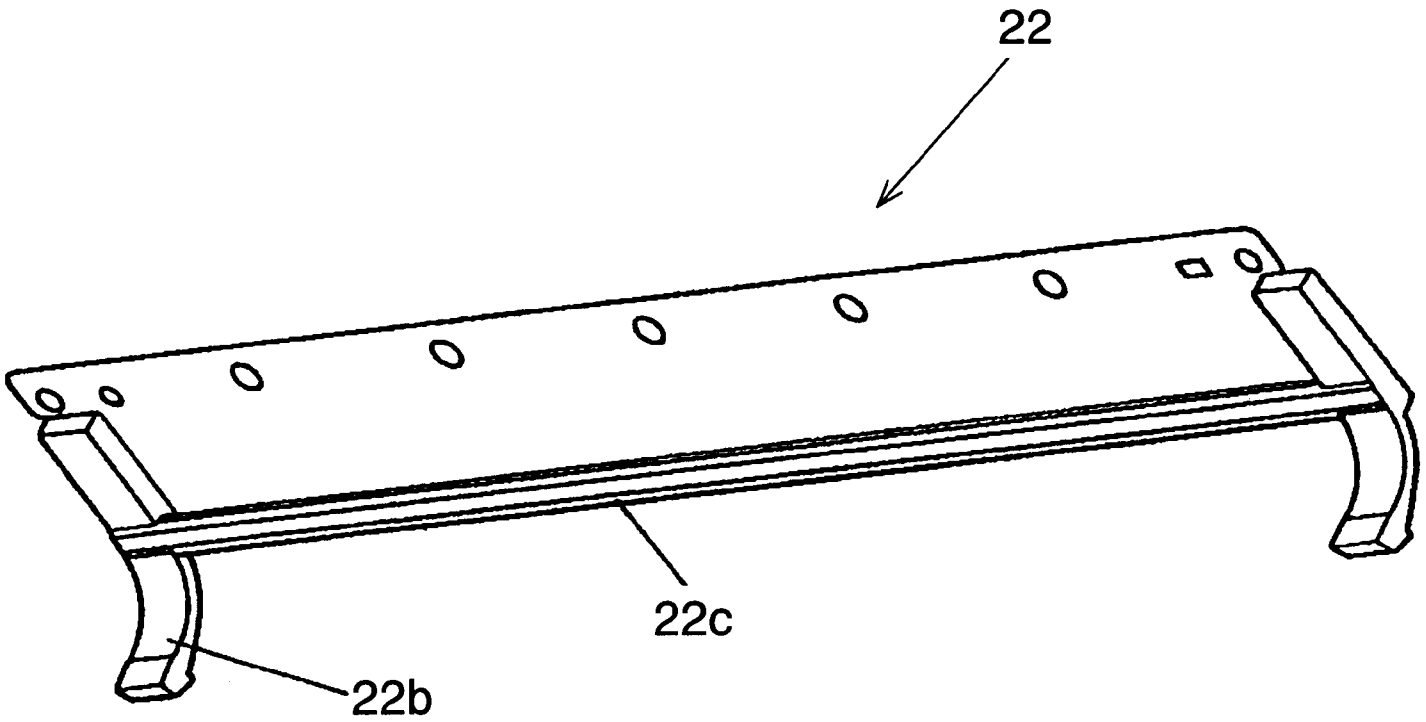
FIG. 11 is a perspective view of an exemplary embodiment of a blade having a function of a toner sealing unit mounted in an image forming apparatus.
Figure 12:
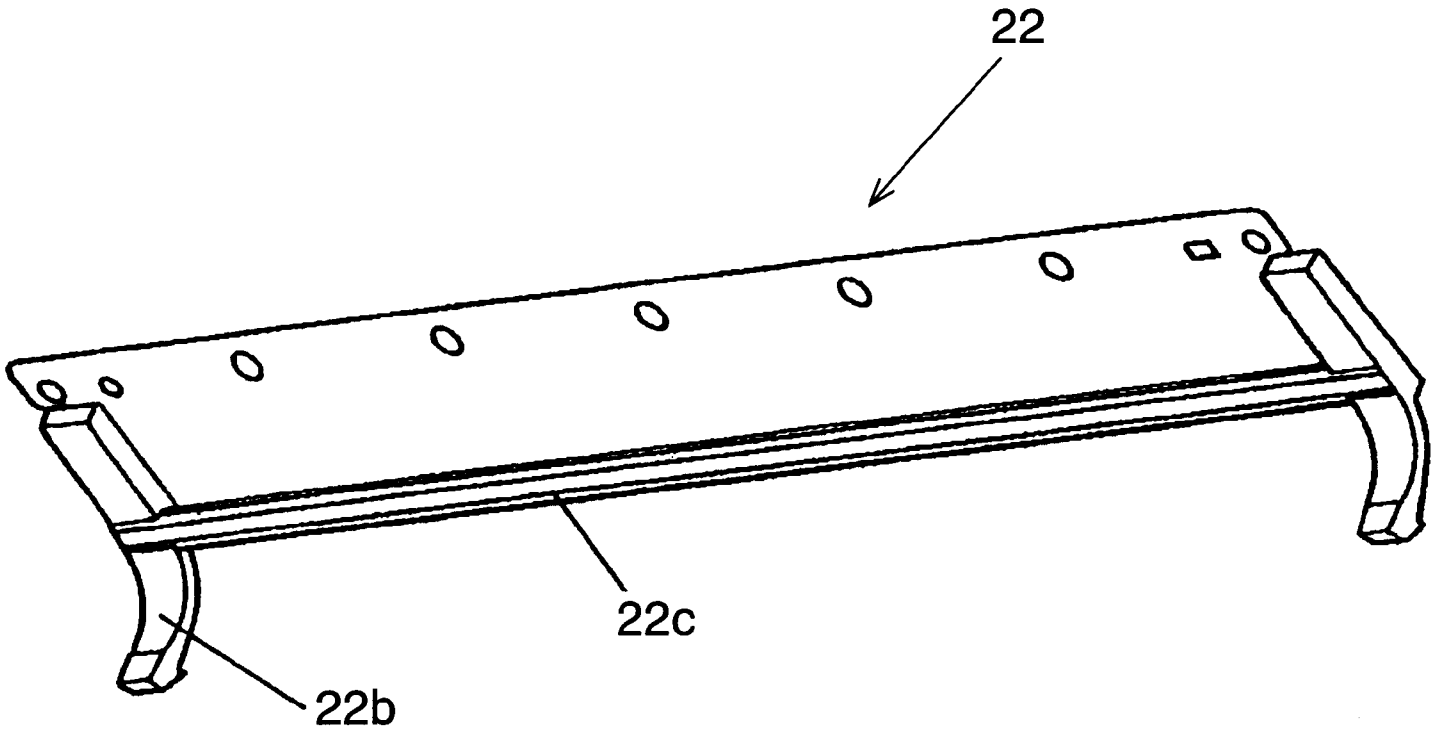
FIG. 12 is a perspective view of another exemplary embodiment of a blade having a function of a toner sealing unit mounted in the image forming apparatus.
Figure 13:
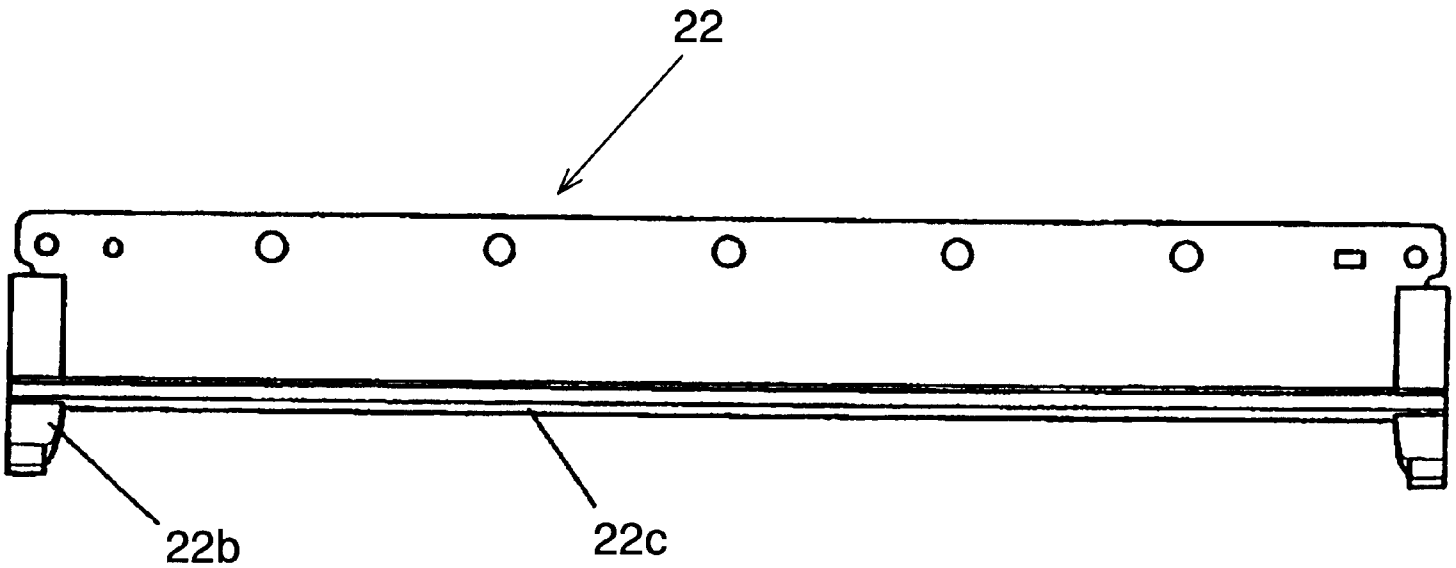
FIG. 13 is a front view of the blade having a function of a toner sealing unit of FIG. 12.

The toner sealing portions 22*b* of the unit 42 tilt toward an inner side of the developing roller 21 along its rotational direction in such a manner that toner is pushed back toward an inside of the housing cassette 30, as shown in FIG. 11. This structure can guide the toner migrating toward the ends of the developing roller 21 back into the housing cassette 30.

Figure 14:
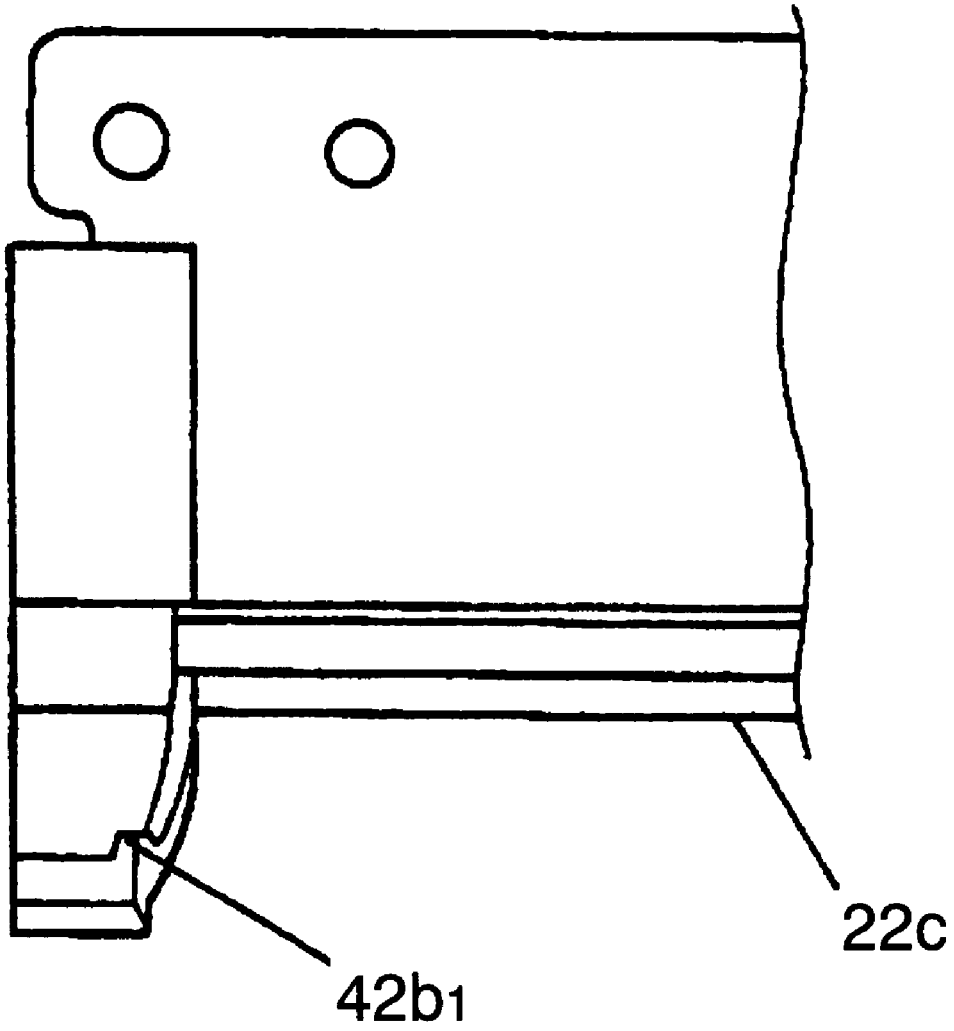
FIG. 14 is another front view of an essential portion of the blade having a function of a toner sealing unit of FIG. 12.
Figure 15:
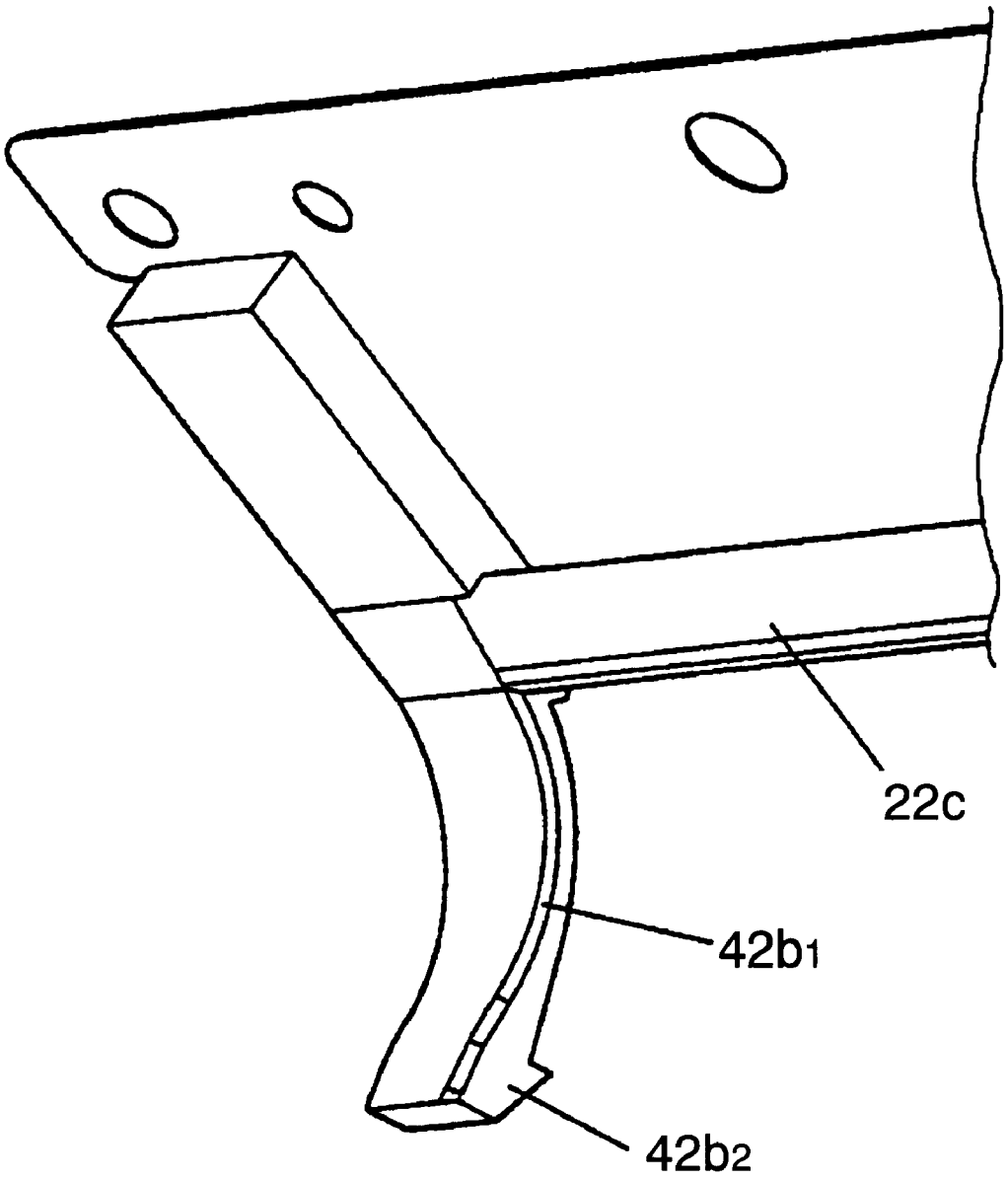
FIG. 15 is a perspective view of another exemplary embodiment of a blade having a function of a toner sealing unit.

In this exemplary embodiment, it is desirable for each of the toner seal portions 22*b* to have a ridge-shaped rib 42*b*1 formed thereon for making contact with the developing roller 21 along its peripheral direction, as shown in FIG. 14. This structure allows each of the toner seal portions 22*b* to keep contact with the developing roller 21 only with the ridge-shaped ribs 42*b*1. Thereby, making it possible to reduce an area of contact, and to prevent an increase of a load torque and a consequent temperature rise due to friction.

The ridge-shaped ribs 42*b*1 can be tilted inwardly towards the developing roller 21, in a manner to make the toner seal portions 22*b* contact linearly with the developing roller 21. This allows the toner seal portions 22*b* to make contact with the developing roller 21 only with the edges of the ridge-shaped ribs 42*b*1. Thereby, making it possible to reduce a contact area, and to prevent an increase of the load torque and the consequent temperature rise due to friction.

In this exemplary embodiment, it is desirable for the ridge-shaped ribs 42*b*1 to be approx. 0.5 to 2.0 mm in height, 0.5 to 1.5 mm in width, and 30 to 60 degrees in tilting angle. It is also desirable for the ridge-shaped ribs 42*b*1 to bite into the image-developing roller 21 at a depth of 0.1 to 0.8 mm.

In addition, it is desirable that the ridge-shaped ribs 42*b*1 provided on the toner sealing portions 22*b* are formed in a leaning manner such that the toner is pushed back into the housing cassette 30 by a rotary movement of the developing roller 21.

If toner gathers behind the ridge-shaped ribs 42*b*1, the toner melts and clings to them because the toner is heated by frictional heat at all times. Therefore, it is preferable for the developing roller 21 to not have any stepped surfaces formed on an inner side in its widthwise direction around the ridge-shaped ribs 42*b*1. This makes it possible to prevent the toner from staying around the toner sealing portions, and clinging due to the frictional heat.

In this exemplary embodiment, polyurethane rubber, PET film, and the like, are used for material of a sheet member 36, and it is desirable for the sheet member 36 to have a thickness of 0.05 to 1.0 mm. The sheet member 36 is adhered to the housing cassette 30 with a double-sided tape, or the like, and is constructed so that it stays in contact with a surface along a longitudinal direction of the developing roller 21 at a distal end or a portion thereof, and has areas where it intersects with the ridge-shaped ribs 42*b*1 of the toner sealing portions 22*b*.

Accordingly, this structure prevents the toner sealing portions 22*b* from being taken away by the developing roller 21, and avoids a seal of the toner from becoming ineffective. In addition, the structure attains a complete filling of the spaces between the sheet member 36 and the toner sealing portions 37 without employing other structural members.

A leakage of toner can occur through gaps between the ridge-shaped ribs 42*b*1 and the developing roller 21, if the blade portion 22*c* is higher than a tip of the ridge-shaped ribs 42*b*1 with respect to the developing roller 21. In addition, a leakage of the toner can also occur through a gap between the blade portion 22*c* and the developing roller 21, if the tips of the ridge-shaped ribs 42*b*1 are higher than the blade portion 22*c*.

Therefore, the structure of this exemplary embodiment is constructed so that the blade portion 22*c* and the tips of the ridge-shaped ribs 42*b*1 are in a concyclic position with respect to the developing roller 21 when these components are assembled. This structure can close the gaps between the developing roller 21 and the blade having a function of a toner sealing unit 42, thereby being capable of preventing the toner from leaking.

Figure 16:
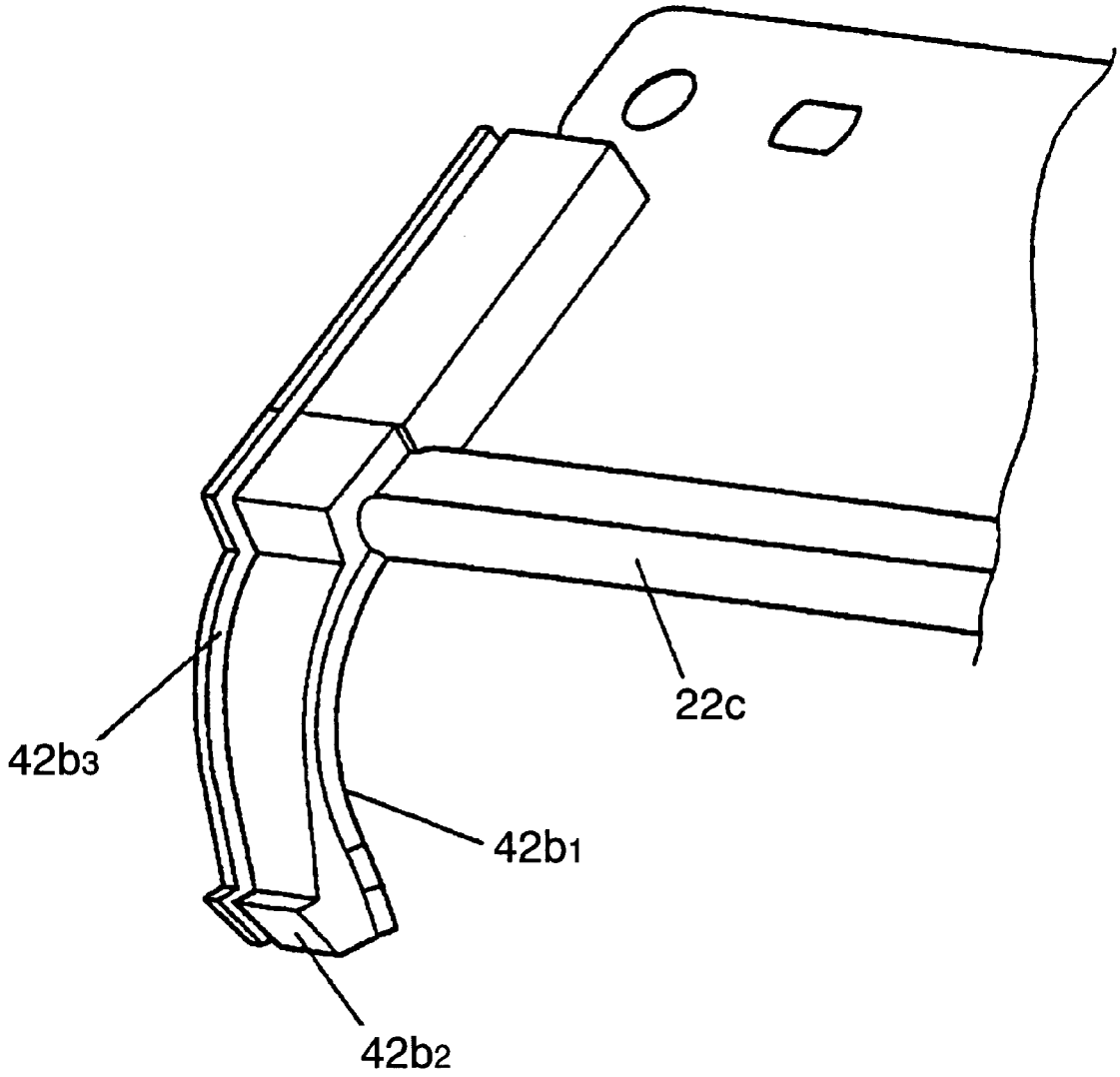
FIG. 16 is a perspective view of still another exemplary embodiment of a blade having a function of a toner sealing unit.

In addition, each of the toner sealing portions 22*b* in this exemplary embodiment may also be provided with a groove 42*b*3 of approx. 0.5 to 3.0 mm in width and approx. 1.0 to 4.0 mm in depth, for instance, formed over an entire length in a peripheral direction in a portion where it keeps contact with the housing cassette 30, in the same manner as the first exemplary embodiment, as shown in FIG. 16. Projections (not show in the figure) are formed in the housing cassette on portions corresponding to the grooves 42*b*3, so that they engage with each other by press-fitting. The grooves and the projections may be reversed in their positions. This makes it unnecessary to fix the toner sealing portions with a double-sided tape or adhesive, thereby making assembling and reassembling them easy. Furthermore, this portion can also prevent the toner from leaking, since they are press-fitted together.

Figure 17:
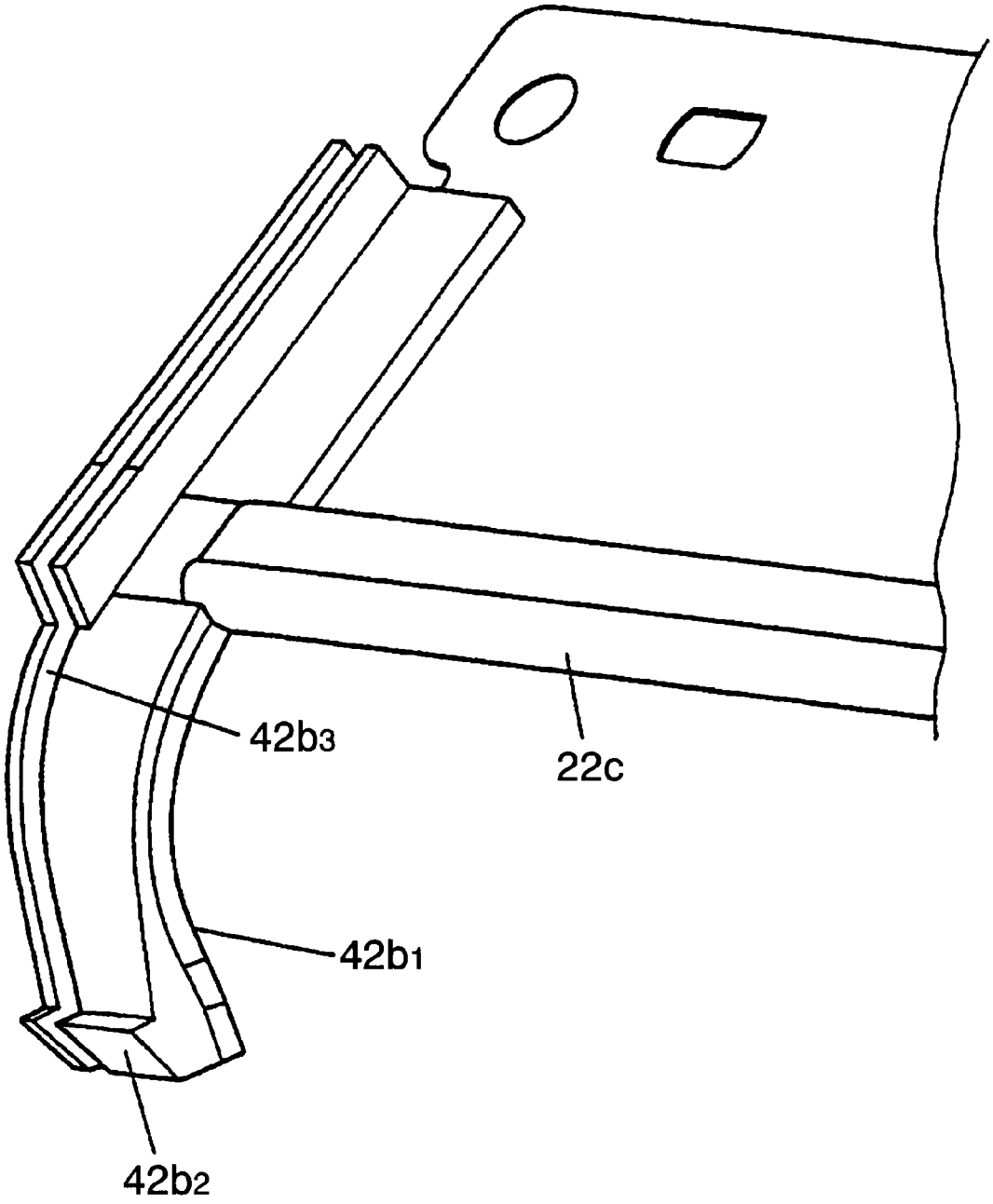
FIG. 17 is a perspective view of yet another exemplary embodiment of a blade having a function of a toner sealing unit.

Furthermore, each of the toner sealing portions 22*b* is provided with a turn-restricting projection 42*b*2, also serving as a positioning means, formed on a side toward the housing cassette 30 at an opposite end from the position where the blade portion 22*c* is mounted, as shown in FIG. 16 and FIG. 17. Also, the housing cassette 30 is provided with turn-restricting recesses (not show in the figure) formed in portions corresponding to the projections 42*b*2, and press-fitting engages them. The projections 42*b*2 are formed in order to prevent the toner sealing portions 22*b* from being taken away by a rotary movement of the image-developing roller 21.

Nitrile rubber, acrylic rubber, silicone rubber, fluorocarbon-rubber, tetrafluorocarbon-resin, and the like are used for the blade having a function of a toner sealing unit 42. With regard to a coefficient of friction, it is desirable for the blade having a function of a toner sealing unit 42 to have a coefficient of dynamic friction in a range of 0.1 to 0.8 for the portion that comes in contact with the developing roller 21. If the coefficient of friction is too low, it tends to easily allow the toner to migrate and to cause toner leakage. If the coefficient of friction is too high, on the other hand, it gives rise to such problems that a load torque of the image developing apparatus increases, and a temperature rise due to friction occurs. When any material other than fluorocarbon-resin is used for the blade having a function of a toner sealing unit 42, it is desirable to provide a coating of fluorocarbon-resin on a portion where it keeps contact with the developing roller 21, in order to reduce the coefficient of friction.

As described above, the following merits are additionally achieved with this exemplary embodiment.

The structure having the ridge-shaped ribs formed on the toner sealing portions enable the toner sealing portions to make contact at their ridge-shaped ribs with the developing roller, it can therefore reduce a contact area between the toner sealing portions and the developing roller. This can make it possible to reduce the load torque and a consequent temperature rise due to friction.

The structure, in which the ridge-shaped ribs are made to contact the developing roller only with edge portion, can reduce the contact area to a minimum, since the toner sealing portions make contact with the developing roller only at the edges of their ridge-shaped ribs. Accordingly, this can further reduce the load torque and the temperature rise.

The structure not providing any stepped surface on the developing roller around the ridge-shaped ribs can prevent the toner from collecting around the toner sealing portions, and prevent the toner from clinging due to frictional heat.

The structure provided with the areas where the sheet member and the ridge-shaped ribs intersect can prevent the toner sealing portions from being taken away by friction of the developing roller, and avoid the seal from becoming ineffective. It can also complete a filling of the space formed between the sheet member and the toner sealing portions.

The structure, in which the blade portion and the ridge-shaped ribs are formed to be in a concyclic position with respect to the image-developing roller, can prevent the toner from leaking, since they can avoid gaps between the toner sealing portions and the developing roller or between the blade portion and the developing roller.

The structure, in which the toner sealing portions and the housing cassette are fixed by the projections and the grooves, makes it easy to assemble and reassemble them together. Furthermore, the engaging portions between them can prevent the toner from leaking.

What is claimed is:

1. An image developing apparatus comprising:

a photosensitive body;

an image-developing roller operable to feed toner to an electrostatic latent image formed on said photosensitive body;

a feeding roller operable to feed the toner to said image-developing roller;

a housing cassette having said image-developing roller and said feeding roller mounted thereon, said housing cassette being operable to store the toner;

a toner layer thickness regulating device having a plate-like shape mounted on said housing cassette, said toner layer thickness regulating device being operable to regulate a layer thickness of the toner fed to said image-developing roller;

a sheet member disposed between a development area of said image-developing roller and a position of pressed contact between said image-developing roller and said feeding roller, said sheet member being operable to prevent the toner from leaking by maintaining a uniform contact with said image-developing roller along a longitudinal direction thereof; and toner sealing means made of a resilient material, said toner sealing means being operable to prevent the toner from leaking, and said toner sealing means being one of fixed integrally to both ends of said toner layer thickness regulating device, and formed integrally as one unit with said toner layer thickness regulating device.

2. The image developing apparatus according to claim 1, wherein said integrally fixed toner sealing means are fixed to said toner layer thickness regulating device by being fitted to both ends of said toner layer thickness regulating device.

3. The image developing apparatus according to claim 1, wherein a space is formed between said toner sealing means and said housing cassette at a portion of said toner sealing means where said toner layer thickness regulating device regulates the layer thickness of the toner.

4. The image developing apparatus according to claim 1, wherein said toner sealing means and said housing cassette are fixed by a projection-and-groove fitting.

5. The image developing apparatus according to claim 1, wherein a coefficient of dynamic friction of said toner sealing means at a portion where said toner sealing means make contact with said image-developing roller is in the range from 0.1 to 0.8.

6. The image developing apparatus according to claim 1, wherein each of said toner sealing means has a ridge-shaped rib formed thereon in an intersecting direction with an axis of said image-developing roller, said ridge-shaped rib being tilted toward an inner side of said image-developing roller.

7. The image developing apparatus according to claim 6, wherein said ridge-shaped ribs are formed in a tilted manner such that the toner is pushed back toward an inside of said housing cassette.

8. The image developing apparatus according to claim 6, wherein said toner layer thickness regulating device and said ridge-shaped ribs are formed in a concyclic position with respect to said image-developing roller.

9. The image developing apparatus according to claim 6, wherein said ridge-shaped ribs are formed such that an upstream side thereof with respect to a rotational direction of said image-developing roller lies outside of a range of layer thickness regulated by said toner layer thickness regulating device, and a downstream side lies inside of the range of layer thickness regulated by aid toner layer thickness regulating device.

10. The image developing apparatus according to claim 6, wherein a distal end of said sheet member is disposed to stay in contact with a surface along a longitudinal direction of said image-developing roller, and said sheet member and said ridge-shaped ribs have areas where they intersect with each other in a circumferential direction of said image-developing roller.

11. An image developing apparatus comprising:

a photosensitive body;

an image-developing roller operable to turn an electrostatic latent image into a visible image by feeding toner to the electrostatic latent image formed on said photosensitive body;

a feeding roller operable to feed the toner to said image-developing roller;

a housing cassette having said image-developing roller and said feeding roller mounted thereon, said housing cassette being operable to store the toner;

a sheet member disposed between a development area of said image-developing roller and a position of pressed contact between said image-developing roller and said feeding roller, said sheet member being operable to prevent the toner from leaking by maintaining a uniform contact with said image-developing roller along a longitudinal direction thereof; and a toner layer thickness regulating means having a function of sealing means, said toner layer thickness regulating means comprising a toner layer thickness regulating portion operable to regulate a layer thickness of the toner and toner sealing portions operable to prevent the toner from leaking, said toner layer thickness regulating portion and said toner sealing portions being formed integrally with a resilient material on a plate-like sheet metal.

12. The image developing apparatus according to claim 11, wherein said toner sealing portions tilt toward an inner side of said image-developing roller.

13. The image developing apparatus according to claim 11, wherein each of said toner sealing portions has a ridge-shaped rib formed thereon.

14. The image developing apparatus according to claim 13, wherein said ridge-shaped ribs tilt toward an inner side of said image-developing roller.

15. The image developing apparatus according to claim 13, wherein said image-developing roller lacks a stepped surface formed inside in a widthwise direction of said image-developing roller where said ridge-shaped ribs contact.

16. The image developing apparatus according to claim 13, wherein said sheet member and said ridge-shaped ribs have areas where they intersect with each other.

17. The image developing apparatus according to claim 13, wherein said toner layer thickness regulating portion and said ridge-shaped ribs are formed in a concyclic position with respect to said image-developing roller.

18. The image developing apparatus according to claim 11, wherein said toner sealing portions and said housing cassette are fixed by a projection-and-groove fitting.

19. The image developing apparatus according to claim 11, wherein a coefficient of dynamic friction of said toner sealing portions in a portion where said toner sealing portions make contact with said image-developing roller is in the range from 0.1 to 0.8.

20. The image developing apparatus according to claim 11, wherein a space is formed between said toner sealing portions and said housing cassette.

* * * * *